US010012430B2

(12) United States Patent
Akalan et al.

(10) Patent No.: US 10,012,430 B2
(45) Date of Patent: Jul. 3, 2018

(54) HOME APPLIANCE DEVICE

(71) Applicant: BSH HAUSGERAETE GMBH, Munich (DE)

(72) Inventors: Yigit Akalan, Tekirdag (TR); Muharrem Uemit Caglin, Istanbul (TR); Ercan Engin, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/357,266

(22) Filed: Nov. 21, 2016

(65) Prior Publication Data

US 2018/0142946 A1 May 24, 2018

(51) Int. Cl.

| | |
|---|---|
| ***A47B 96/04*** | (2006.01) |
| ***F25D 23/10*** | (2006.01) |
| ***F25D 23/08*** | (2006.01) |
| ***F25D 11/00*** | (2006.01) |
| ***A47B 95/00*** | (2006.01) |
| ***D06F 39/12*** | (2006.01) |
| ***A47L 15/42*** | (2006.01) |
| ***F24C 15/30*** | (2006.01) |
| ***E04F 19/02*** | (2006.01) |

(52) U.S. Cl.

CPC ..... *F25D 23/10* (2013.01); *A47B 95/00* (2013.01); *A47L 15/4251* (2013.01); *D06F 39/12* (2013.01); *E04F 19/02* (2013.01); *F24C 15/30* (2013.01); *F25D 11/00* (2013.01); *F25D 23/08* (2013.01); *F25D 2400/18* (2013.01)

(58) Field of Classification Search

CPC ..... F25D 23/08; F25D 23/082; F25D 23/10; F25D 2400/18; A47B 95/002; A47B 95/00; A47B 2095/004; A47L 15/4251; D06F 39/12; E04F 19/02; E04F 19/022; E04F 19/04; F24C 15/30

See application file for complete search history.

(56) References Cited

U.S. PATENT DOCUMENTS 3,351,400 A * 11/1967 Sholtes ..... A47B 47/03 312/107
3,937,133 A * 2/1976 Bertin ..... F24F 13/075 312/111
4,831,804 A * 5/1989 Sayer ..... E06B 3/222 52/204.593

(Continued)

FOREIGN PATENT DOCUMENTS

DE 102005057144 A1 6/2007

*Primary Examiner* — Hanh V Tran

(74) *Attorney, Agent, or Firm* — Laurence A. Greenberg; Werner H. Stemer; Ralph E. Locher

(57) ABSTRACT

For the purpose of providing a home appliance device with improved characteristics regarding user convenience, a home appliance device, in particular a home chiller appliance device, is proposed with at least one bridging unit which is configured for bridging at least one gap between at least one appliance body and at least one part of a piece of furniture, the bridging unit comprising at least one first bridging element and at least one second bridging element that at least partly engages into the first bridging element in at least one assembled state. The second bridging element includes at least one flexible connecting link that is guided in at least one at least sectionally curved guiding slot of the first bridging element.

14 Claims, 3 Drawing Sheets

(56) References Cited

U.S. PATENT DOCUMENTS

| | | | | |
|---|---|---|---|---|
| 5,381,844 | A * | 1/1995 | Struben | E04H 15/08 135/88.1 |
| 6,557,259 | B1 * | 5/2003 | Nguyen | A45D 29/02 132/75.5 |
| 6,997,530 | B2 * | 2/2006 | Avendano | A47B 47/02 312/265.6 |
| 8,079,652 | B2 | 12/2011 | Laible et al. | |
| 8,439,460 | B2 * | 5/2013 | Laible | F25D 23/10 312/204 |
| 8,985,093 | B2 * | 3/2015 | Ingersoll | F24C 15/08 126/19 R |
| 9,322,590 | B1 * | 4/2016 | Phillips | F25D 23/10 |
| 2003/0230955 | A1 * | 12/2003 | Welch | A47B 77/02 312/228 |
| 2004/0168384 | A1 * | 9/2004 | Wesolowska | E04F 19/04 52/287.1 |
| 2008/0252186 | A1 * | 10/2008 | Crompton | F25D 23/10 312/204 |
| 2009/0151385 | A1 * | 6/2009 | Hagele | F25D 23/062 62/298 |
| 2009/0252548 | A1 * | 10/2009 | Laible | A47B 95/002 403/291 |
| 2009/0272044 | A1 * | 11/2009 | Newhouse | A47B 96/00 52/27 |
| 2010/0031580 | A1 * | 2/2010 | Lee | F25D 23/028 49/504 |
| 2010/0244646 | A1 * | 9/2010 | Laible | E05D 11/0054 312/405 |

* cited by examiner

HOME APPLIANCE DEVICE

BACKGROUND OF THE INVENTION

The invention relates to a home appliance device, in particular a home chiller appliance device.

From the German patent application DE 10 2005 057 144 A1 a home appliance device is known comprising a bridging unit which is configured for bridging a gap between an appliance body and a part of a piece of furniture. A first bridging element of the bridging unit has a vertical guiding slot in which a rigid vertical connecting link is inserted. In case of a small gap between the appliance body and the part of the piece of furniture the connecting link has to be cut.

SUMMARY OF THE INVENTION

An objective of the invention is, in particular, to provide a home appliance device with improved characteristics regarding user convenience. This objective is achieved, according to the invention, as claimed, while further implementations and further developments of the invention may be gathered from the dependent claims.

A home appliance device, for example a home chiller appliance device, is proposed, comprising at least one bridging unit which is configured for bridging at least one gap between at least one appliance body and at least one part of a piece of furniture, the bridging unit comprising at least one first bridging element and at least one second bridging element that at least partly engages into the first bridging element in at least one assembled state, the second bridging element comprising at least one flexible connecting link that is guided in at least one at least sectionally curved guiding slot of the first bridging element.

By a "home appliance device" is in particular to be understood at least a portion, preferably a sub-assembly group, of a home appliance. The home appliance is in particular provided for storing and preferably tempering victuals such as beverages, meat, fish, vegetables, fruits, milk and/or dairy products in at least one operating state, for example for the purpose of enhancing a storage life of the stored victuals. For example, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven and/or a cooker and/or a microwave. Alternatively the home appliance could also be embodied as a home appliance for cleaning, e.g. a washing machine and/or a dryer and/or dishwasher. The home appliance may in particular comprise at least two, in particular at least three and in particular also at least four home appliance devices.

A "bridging unit" is in particular to be understood as a unit filling the gap between the appliance body and the part of the piece of furniture at least mostly or completely considering tolerances, in particular in a viewing direction that is oriented away from a front side of the appliance body. The term "at least mostly" with reference to an object is in particular to mean by more than 50% or by more than 65% or by more than 80% or by more than 95% of the object, in particular of a surface area and/or of a volume and/or of a mass of the object. In particular, the home appliance device comprises the appliance body. In at least one assembled state, the bridging unit, in particular at least one of the bridging elements of the bridging unit and preferably the first bridging element, is in particular in contact with at least one portion of the appliance body. The bridging unit, in particular at least one of the bridging elements of the bridging unit and preferably the second bridging element, being in particular configured for contacting the part of the piece of furniture. In particular, the bridging unit is configured for closing the gap between the appliance body and the part of the piece of furniture An "appliance body" is in particular to be understood as a unit which at least partly defines at least one storage space and in particular defines the storage space at least substantially together with at least one appliance door, in at least one operating state. In particular, the home appliance device comprises the appliance door. The appliance body and the appliance door in particular define the storage space in at least one operating state at least substantially and preferably considering tolerances completely. The appliance body in particular comprises at least two or at least four or at least five walls. The walls in particular delimit the storage space. The walls may in particular be embodied as a lateral wall and/or as a rear wall and/or as a bottom wall and/or as a top wall. The appliance body in particular has two lateral walls, e.g. opposite each other, one rear wall, one bottom wall and one top wall which is preferably located opposite the bottom wall. The piece of furniture may in particular be a cupboard and/or a cabinet and/or a top plate, in particular a worktop, and/or a housing of a further home appliance.

The term that the second bridging element "at least partly" engages into the first bridging element in at least one assembled state is in particular to mean that at least a portion of the second bridging element engages into the first bridging element in at least one assembled state, wherein at least one further portion of the second bridging element may be located outside the first bridging element in the assembled state.

By a "flexible" connecting link is in particular to be understood that in case a force of 10 N acts onto the connecting link, the connecting link is bent and/or deflected by at least 1 mm or by at least 3 mm or by at least 5 mm or by at least 10 mm, and/or by at least 1% or by at least 3% or by at least 5% or by at least 10% of a longitudinal extension of the connecting link. In this context, a "longitudinal extension" of an object is in particular to be understood as an extension of the longest side of an imaginary smallest rectangular cuboid just still entirely encompassing the object.

By the term that the first bridging element comprises at least one "at least sectionally" curved guiding slot is in particular to be understood that at least a section of the first bridging element is a curved guiding slot, wherein at least one further section of the first bridging element may be a straight guiding slot and/or free of any guiding slot.

In this context, "configured" is in particular to mean specifically programmed, designed and/or equipped. By an object being configured for a certain function is in particular to be understood that the object implements and/or fulfills said certain function in at least one application state and/or operating state.

By means of the invention in particular a convenience for a user of the home appliance device can be improved. An installer can in particular easily introduce the bridging unit into the gap between the appliance body and the part of the piece of furniture, wherein a cutting process can in particular be avoided. In particular, an easy and/or quick installation of the bridging unit can be provided. A durable and/or safe fixing can in particular be provided.

Further, it is proposed that the curved guiding slot may be curved in a direction away from a front side of the appliance body. The direction away from a front side of the appliance body is in particular oriented from the appliance door to at least one rear wall of the appliance body in at least one operating state. As a result of this, a compact embodiment can in particular be provided.

For example, the first bridging element may comprise only the curved guiding slot. The first bridging element may comprise at least one, at least substantially or by considering tolerances completely, vertical guiding slot, into which the connecting link is insertable. In at least one assembled state, the vertical guiding slot may be in particular oriented at least substantially perpendicularly to at least one wall, in particular to the top wall and/or to the bottom wall, of the appliance body. On account of this, an easy and/or fast assembly process can in particular be provided, thereby in particular saving costs.

The vertical guiding slot may, in an assembly position, for example, be located behind the curved guiding slot and in particular in prolongation of the curved guiding slot in the direction away from a front side of the appliance body. For example the vertical guiding slot is, in an assembly position, located above the curved guiding slot. In particular, the connecting link can enter the vertical guiding slot before entering the curved guiding slot. As a result of this, an easy insertion of the connecting link in the guiding slot can be provided, thus in particular reducing assembly time.

Additionally, it is proposed that the connecting link may comprise at least two projections, which are separated from each other by at least one flexible region. In particular, the connecting link may be curved at the flexible region. In an alternative embodiment it is in particular possible that the connecting link may be cut off at the flexible region, thus in particular reducing a length of the connecting link and/or adapting a height of the bridging unit to a height of the gap between the appliance body and the part of the piece of furniture. On account of this, the flexible region can in particular be provided in an easy and/or cost-saving manner.

Furthermore, it is proposed that the connecting link may at least mostly have a sawtooth-like profile when viewed in at least one viewing direction. The sawtooth-like profile is in particular at least mostly or, when considering tolerances, completely defined by the projections and the flexible region, for example by a combination of several projections and several flexible regions. In particular, the sawtooth-like profile may be curved in a direction away from a front side of the appliance body. The projections may for example have at least mostly the same height. In particular, there may for example be one flexible region between two neighboring projections. The regularly alternating arrangement of projections, which in particular may have at least mostly the same height, and flexible regions may in particular define a sawtooth-like profile of the connecting link when viewed in at least one viewing direction. Alternatively and/or additionally the connecting link may comprise at least two projections and at least one further projection and at least two flexible regions. The projections may for example have at least mostly the same height. The further projections may for example have a smaller height than the projections. The further projections may in particular be located between two projections. For example, the flexible regions may be located between two neighboring projections, in particular regardless of the kind of projection. As a result of this, a high degree of flexibility can be provided.

The first bridging element may in particular comprise at least two first bridging subcomponents which are connected and/or fixed to each other. Alternatively, the first bridging element may be made of one piece. "Made of one piece" is in particular to mean, in this context, manufactured from one single piece, e.g. by production from one single cast and/or by manufacturing in a one-component or multi-component injection-molding process, and for example from a single blank. On account of this, a high degree of stability can in particular be provided.

For example, the second bridging element may comprise at least two second bridging subcomponents which are connected and/or fixed to each other. Alternatively, the second bridging element is made of one piece. As a result of this, stability can be improved.

In particular the first bridging element may at least mostly be made of metal. For example the first bridging element is at least mostly made of aluminum. This allows the first bridging element having enhanced stability. Alternatively or additionally, the first bridging element may at least mostly be made of plastic.

Further, it is proposed that the second bridging element may at least mostly be made of plastic. As a result of this, a cost-saving implementation can be provided.

A very high convenience for a user can in particular be achieved by a home appliance, in particular by a home chiller appliance, comprising at least one home appliance device according to the invention.

In a preferred implementation of the invention, a system is proposed comprising a home appliance according to the invention; the appliance body; and the part of the piece of furniture. On account of this, an optimum convenience for a user can in particular be achieved.

A convenience for a user can in particular be improved by a method using the home appliance device, in particular the home chiller appliance device according to the invention, for bridging the gap between the appliance body and the part of the piece of furniture, wherein the flexible connecting link of the second bridging element is inserted into the at least sectionally curved guiding slot of the first bridging element.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
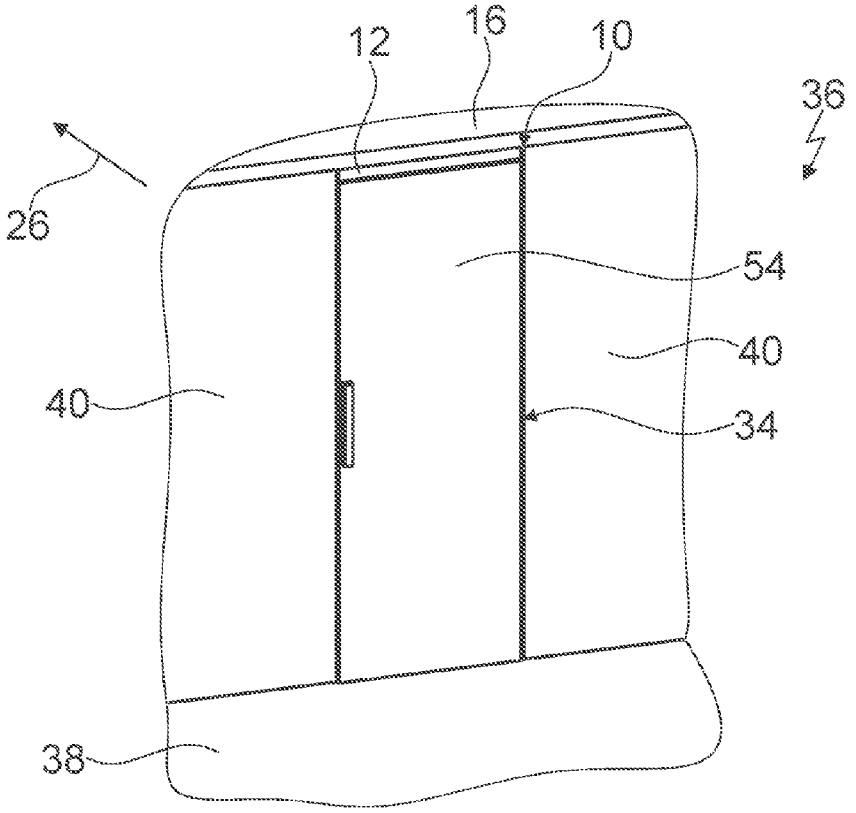
FIG. 1 a system comprising a piece of furniture and a home appliance comprising a home appliance device, in a schematic front view, FIG. 2 the system comprising the piece of furniture and the home appliance comprising the home appliance device, in a schematic front view, FIG. 3 a bridging unit of the home appliance device in a first assembly position, in a schematic perspective view, FIG. 4 a first bridging element of the bridging unit in a schematic perspective view, FIG. 5 a second bridging element of the bridging unit, in a schematic perspective view, FIG. 6 the bridging unit in a second assembly position, in a schematic perspective view, FIG. 7 the bridging unit in a third assembly position, in a schematic perspective view and FIG. 8 the bridging unit in an assembled state, in a schematic perspective view.
Figure 2:
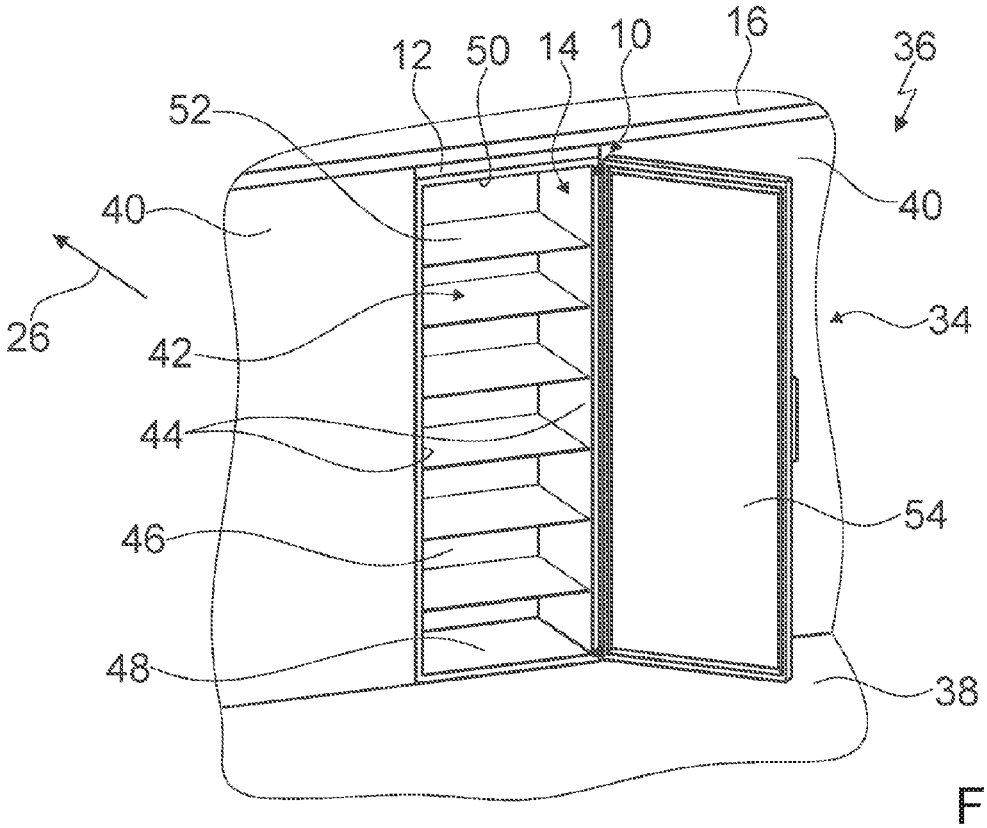
Figure 3:
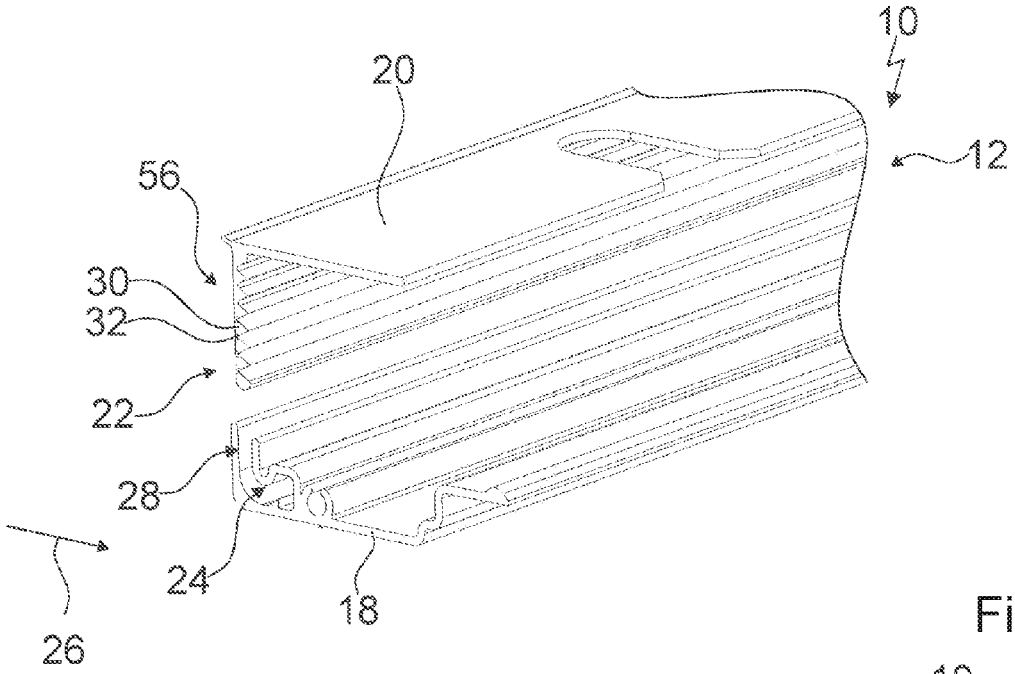
Figure 4:
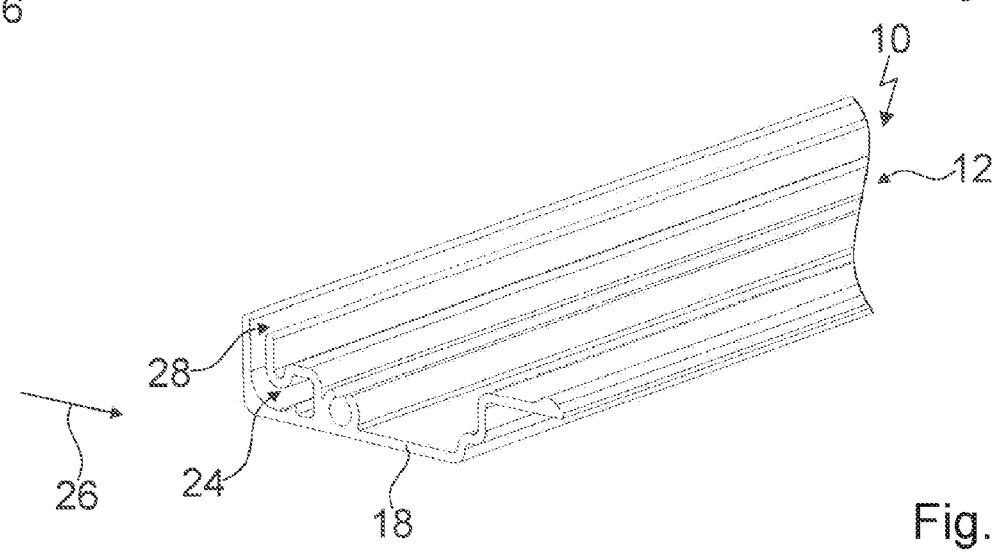
Figure 5:
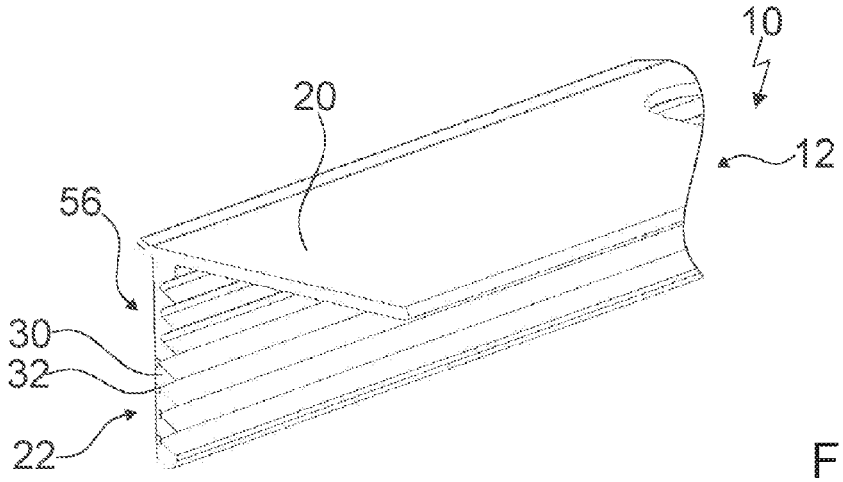
Figure 6:
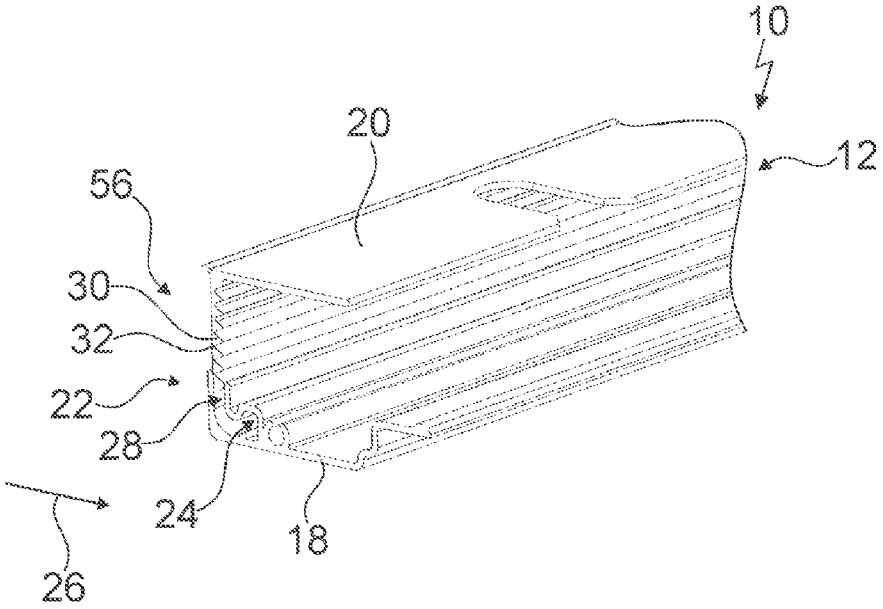
Figure 7:
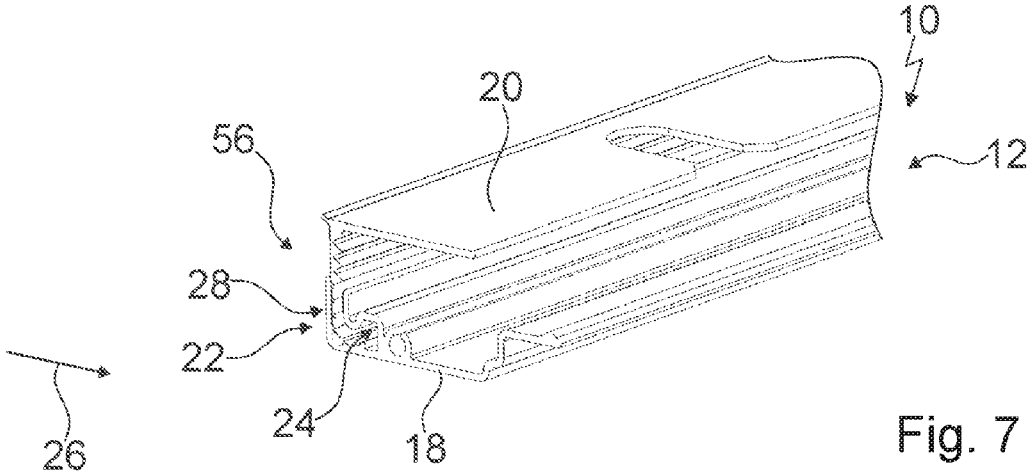
Figure 8:
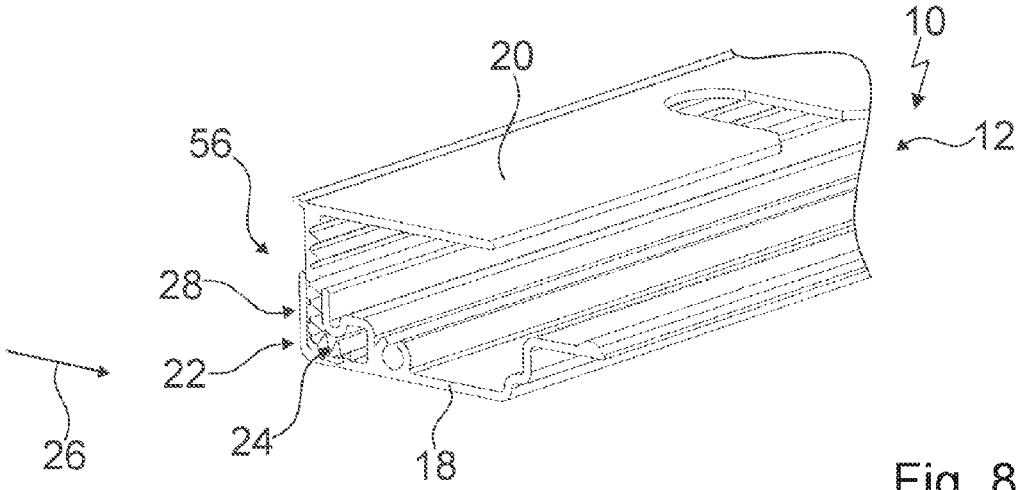

FIG. 1 shows a system 36 comprising a piece of furniture 16 and a home appliance 34 in a schematic front view. The home appliance 34 is embodied as a home chiller appliance.

In the present embodiment the home appliance 34 is embodied as a refrigerator. The home appliance 34 could further in particular be embodied as a wine cooler, a climate cabinet, an ice-box, a freezer and/or a refrigerator-freezer combination.

The home appliance 34 comprises a home appliance device 10. The home appliance device 10 is embodied as a home chiller appliance device.

In FIG. 1 the home appliance device 10 is shown in an installation position. The home appliance device 10 is installed on a base 38. The base 38 defines a substantially horizontal plane.

The home appliance device 10 comprises an appliance body 14. The appliance body 14 partly defines an appliance housing. The appliance body 14 is installed substantially upright on the base 38. The appliance body 14 is part of the system 36.

The appliance body 14 defines partly a storage space 42. The appliance body 14 comprises walls 44, 46, 48, 50. The walls 44, 46, 48, 50 delimit the storage space 42. The appliance body 14 has two lateral walls 44, preferably opposite each other. The appliance body 14 has a rear wall 46. The appliance body 14 has a bottom wall 48. The appliance body 14 has a top wall 50, preferably opposite the bottom wall 48.

The home appliance device 10 comprises at least one insert 52. In the present case the home appliance device comprises six inserts 52. It is conceivable that the home appliance device may comprise a deviating number of inserts 52 as deemed advantageous by someone skilled in the art. The home appliance device 10 may preferably comprise a combination of different embodiments of inserts 52, for example at least one insert 52 embodied as a shelf and at least one further insert 52 embodied as a bottle holder. For the sake of clarity, in the following only one insert 52 is given a reference numeral and is described in detail. The following description may be transferred to further inserts 52 accordingly.

The home appliance device 10 comprises at least one appliance door 54. In the present case the home appliance device 10 comprises one appliance door 54. The appliance door 54 is connected to the appliance body 14. In a mounted state, the appliance door 54 is rotatably connected to the appliance body 14.

In an installation position, the home appliance device 10 is located underneath the piece of furniture 16. The home appliance 10 comprises a bridging unit 12. The bridging unit 12 bridges a gap between the appliance body 14 and a part of the piece of furniture 16. In an installation position, the bridging unit 12 is located between the appliance body 14 and the part of the piece of furniture 16.

Next to the home appliance device 10, a further piece of furniture 40 is arranged. The further piece of furniture 40 is part of the system 36. In an alternative embodiment the bridging unit 12 may for example bridge a gap between the appliance body 14 and a part of the further piece of furniture 40.

The bridging unit 12 comprises one first bridging element 18 (cf. FIGS. 3 to 8). The first bridging element 18 is made of one piece. In an installation position, the first bridging element 18 is located in contact with the appliance body 14. The first bridging element 18 is mostly made of aluminum.

The bridging unit 12 comprises a second bridging element 20 (cf. FIGS. 3 to 8). The second bridging element 20 is made of one piece. In an installation position, the second bridging element 20 is located in contact with the part of the piece of furniture 16. The second bridging element 20 is mostly made of plastic.

In an assembled state, the second bridging element 20 partly engages into the first bridging element 18. The first bridging element 18 comprises one sectionally curved guiding slot 24. In an assembled state, the second bridging element 20 engages into the sectionally curved guiding slot 24 of the first bridging element 18.

The second bridging element comprises a flexible connecting link 22. The connecting link 22 is guided in the sectionally curved guiding slot 24 of the first bridging element 18.

The curved guiding slot 24 is curved in a direction 26 facing away from a front side of the appliance body 14. In an installation position, the curved guiding slot 24 is curved inwards. The curved guiding slot 24 is curved by substantially about 90°.

The first bridging element 18 comprises a substantially vertical guiding slot 28. In an installation position, the vertical guiding slot 28 is substantially vertical to the base 38. The vertical guiding slot 28 is, in an assembly position, located above the curved guiding slot 24.

Before entering the curved guiding slot 24, the connecting link 22 is guided in the vertical guiding slot 28 of the first bridging element 18. Therefore, the connecting link 22 is insertable in the vertical guiding slot 28.

In the present embodiment, the connecting link 22 comprises four projections 30. The connecting link 22 comprises four flexible regions 32. The projections 30 are separated from each other by the flexible regions 32. Two neighboring projections 30 are separated from each other by one of the flexible regions 32.

The first projection 30 of the connecting link 22 is separated from a further link 56 of the second bridging element 20 by one of the flexible regions 32. In an installation position, the further link 56 is located above the connecting link 22. The further link 56 is substantially rigid, in particular compared to the connecting link 22.

When viewed in a viewing direction, the connecting link 22 mostly has a sawtooth-like profile. The further link 56 mostly has a sawtooth-like profile, when viewed in a viewing direction.

In a method for bridging a gap between the appliance body 14 and the part of the piece of furniture 16 using the home appliance device 10, the flexible connecting link 22 of the second bridging element 20 is inserted into the sectionally curved guiding slot 24 of the first bridging element 18.

In a first assembly step, the first bridging element 18 and the second bridging element 20 are positioned with respect to one another. For example, the second bridging element 20 may be located above the first bridging element 18 (cf. FIG. 3).

In the following the case that the second bridging element 20 is moved with respect to the first bridging element 18 is considered. Alternatively and/or additionally the first bridging element 18 may be moved relative to the second bridging element 20.

The second bridging element 20 is moved in a direction towards the first bridging element 18. The connecting link 22 is inserted into the vertical guiding slot 28 (cf. FIG. 6). The second bridging element 20 is moved further in the direction towards the first bridging element 18. The connecting link 22 is inserted into the curved guiding slot 24 (cf. FIG. 7).

The extension by which the connecting link 22 is inserted into the curved guiding slot 24 depends on an extension of the gap between the appliance body 14 and the part of the piece of furniture 16. While the connecting link 22 is inserted into the curved guiding slot 24, the connecting link 22 is bent.

The following is a summary list of reference numerals and the corresponding structure used in the above description of the invention:

10 Home appliance device
12 Bridging unit
14 Appliance body
16 Piece of furniture
18 First bridging element
20 Second bridging element
22 Connecting link
24 Curved guiding slot
26 Direction
28 Vertical guiding slot
30 Projection
32 Flexible region
34 Home appliance
36 System
38 Base
40 Further piece of furniture
42 Storage space
44 Wall
46 Wall
48 Wall
50 Wall
52 Insert
54 Appliance door
56 Further link

The invention claimed is:

1. A home appliance device, in particular a home chiller appliance device, comprising at least one bridging unit which is configured for bridging at least one gap between at least one appliance body and at least one part of a piece of furniture, the bridging unit comprising at least one first bridging element and at least one second bridging element that at least partly engages into the first bridging element in at least one assembled state, the second bridging element comprising at least one flexible connecting link that is guided in at least one at least sectionally curved guiding slot of the first bridging element, wherein said at least one flexible connecting link is influenced by the curvature of said at least one sectionally curved guiding slot upon being guided in.

2. The home appliance device according to claim 1, the curved guiding slot being curved in a direction facing away from a front side of the appliance body.

3. The home appliance device according to claim 1, the first bridging element comprising at least one at least substantially vertical guiding slot in which the connecting link is insertable.

4. The home appliance device according to claim 3, the vertical guiding slot being, in an assembly position, located above the curved guiding slot.

5. The home appliance device according to claim 1, the connecting link comprising at least two projections, which are separated from each other by at least one flexible region.

6. The home appliance device according to claim 1, the connecting link at least mostly having a sawtooth-like profile when viewed in at least one viewing direction.

7. The home appliance device according to claim 1, the first bridging element being made of one piece.

8. The home appliance device according to claim 1, the second bridging element being made of one piece.

9. The home appliance device according to claim 1, the first bridging element being at least mostly made of aluminum.

10. The home appliance device according to claim 1, the second bridging element being at least mostly made of plastic.

11. A home appliance, in particular a home chiller appliance, comprising at least one home appliance device according to claim 1.

12. A system comprising a home appliance according to claim 11; the appliance body; and the part of the piece of furniture.

13. A method using a home appliance device, in particular a home chiller appliance device, according to claim 1, for bridging the gap between the appliance body and the part of the piece of furniture, wherein the flexible connecting link of the second bridging element is inserted into the at least one sectionally curved guiding slot of the first bridging element.

14. A home appliance device, in particular a home chiller appliance device, comprising at least one bridging unit which is configured for bridging at least one gap between at least one appliance body and at least one part of a piece of furniture, the bridging unit comprising at least one first bridging element and at least one second bridging element that at least partly engages into the first bridging element in at least one assembled state, the second bridging element comprising at least one flexible connecting link that is guided in at least one at least sectionally curved guiding slot of the first bridging element, wherein said at least one flexible connecting link is curved by a curvature of said at least one sectionally curved guiding slot upon being guided in.

* * * * *